US009810227B2

(12) United States Patent
Gajewski

(10) Patent No.: US 9,810,227 B2
(45) Date of Patent: Nov. 7, 2017

(54) CEILING FAN

(71) Applicant: MINKA LIGHTING, INC., Corona, CA (US)

(72) Inventor: Mark Gajewski, Avila Beach, CA (US)

(73) Assignee: Minka Lighting, Inc., Corona, CA (US)

( * ) Notice: Subject to any disclaimer, the term of this patent is extended or adjusted under 35 U.S.C. 154(b) by 320 days.

(21) Appl. No.: 14/598,073

(22) Filed: Jan. 15, 2015

(65) Prior Publication Data

US 2015/0198180 A1 Jul. 16, 2015

Related U.S. Application Data

(60) Provisional application No. 61/965,069, filed on Jan. 16, 2014.

(51) Int. Cl.

| | |
|---|---|
| ***F04D 25/08*** | (2006.01) |
| ***F04D 29/34*** | (2006.01) |
| ***F04D 29/64*** | (2006.01) |

(52) U.S. Cl.

CPC ..... *F04D 25/088* (2013.01); *F04D 29/34* (2013.01); *F04D 29/646* (2013.01); *Y10T 29/49327* (2015.01)

(58) Field of Classification Search

CPC ..... F04D 29/34; F04D 25/088

See application file for complete search history.

(56) References Cited

U.S. PATENT DOCUMENTS

| | | | | |
|---|---|---|---|---|
| 3,930,332 | A * | 1/1976 | Seefluth | A63H 27/12 244/17.11 |
| 4,342,073 | A | 7/1982 | Ranten | |
| 4,715,784 | A * | 12/1987 | Mosiewicz | F01D 5/3069 29/557 |
| D297,360 | S | 8/1988 | Cheslock | |
| 4,822,246 | A * | 4/1989 | Hsu | F04D 29/384 416/175 |
| D337,156 | S | 7/1993 | Jaeger | |
| D346,438 | S | 4/1994 | Caldwell | |
| D346,858 | S | 5/1994 | Lee | |
| D355,027 | S | 1/1995 | Young | |
| D356,152 | S | 3/1995 | Collmar | |
| D377,975 | S | 2/1997 | Young | |
| D384,737 | S | 10/1997 | Gee, II | |
| D408,518 | S | 4/1999 | Liu | |
| D409,297 | S | 5/1999 | Tai | |
| D448,840 | S | 10/2001 | Gajewski | |
| 6,354,801 | B1 * | 3/2002 | Gajewski | F04D 25/088 415/121.2 |
| D476,728 | S | 7/2003 | Gajewski | |
| D477,068 | S | 7/2003 | Hsieh | |

(Continued)

*Primary Examiner* — Woody Lee, Jr.

(74) *Attorney, Agent, or Firm* — Baker & McKenzie LLP

(57) ABSTRACT

The present disclosure relates, in some embodiments, to ceiling fans. More specifically, the present disclosure relates to ceiling fans that may comprise a body comprising a top cover, a bottom cover, and an internal cavity therebetween. Curvilinear segments of the top cover may contour against curvilinear segments of the bottom cover. Fan blades may be secured between the top cover and the bottom cover, and may extend through a lateral recess of the body. The top cover and the bottom cover may form a body comprising a substantially discoidal or substantially oblate spheroid geometry.

30 Claims, 17 Drawing Sheets

(56) References Cited

U.S. PATENT DOCUMENTS

| | | | | |
|---|---|---|---|---|
| D489,124 | S | 4/2004 | Young | |
| 6,782,579 | B1 | 8/2004 | Grimm | |
| D519,625 | S | 4/2006 | Young | |
| D576,265 | S | 9/2008 | Bucher | |
| D590,489 | S | 4/2009 | Bucher | |
| D596,733 | S | 7/2009 | Kihara | |
| D596,734 | S | 7/2009 | Kihara | |
| D599,461 | S | 9/2009 | Ertze | |
| D612,476 | S | 3/2010 | Noble | |
| D614,759 | S | 4/2010 | Shurtleff | |
| D627,874 | S | 11/2010 | Pan | |
| D660,953 | S | 5/2012 | Allen | |
| D663,829 | S | 7/2012 | Allen | |
| D678,997 | S | 3/2013 | Gajewski | |
| D706,920 | S | 6/2014 | Cohen | |
| D715,418 | S | 10/2014 | Schulzman | |
| D716,436 | S | 10/2014 | Johnson | |
| D719,252 | S | 12/2014 | Allen | |
| 2005/0141997 | A1 | 6/2005 | Rast | |
| 2008/0069698 | A1 | 3/2008 | Laisathit | |
| 2009/0122572 | A1 | 5/2009 | Page | |
| 2009/0129974 | A1 | 5/2009 | McEllen | |
| 2013/0189109 | A1 | 7/2013 | Noble | |
| 2013/0272879 | A1 | 10/2013 | Chen | |
| 2013/0336797 | A1* | 12/2013 | Wang | F04D 29/329 416/214 R |

* cited by examiner

CEILING FAN

CROSS-REFERENCE TO RELATED APPLICATIONS

This Application claims priority to U.S. Provisional Application No. 61/965,069 filed on Jan. 16, 2014. The entire contents of the Application listed above are hereby incorporated by reference in their entirety.

FIELD OF THE DISCLOSURE

The present disclosure relates, in some embodiments, to ceiling fans. More specifically, the present disclosure relates to ceiling fans that may comprise two clasping or contouring covers with curvilinear segments.

SUMMARY

The present disclosure relates, in some embodiments, to ceiling fans. More specifically, the present disclosure relates to ceiling fans that may comprise a body comprising a top cover, a bottom cover, and an internal cavity therebetween. Curvilinear segments of the top cover may contour against curvilinear segments of the bottom cover. Fan blades may be secured between the top cover and the bottom cover, and may extend through a lateral recess of the body. The top cover and the bottom cover may form a body comprising a substantially discoidal or substantially oblate spheroid geometry.

In some embodiments, the bottom cover of the body may comprise a center recess. The bottom cover of the body may further comprise a cover panel disposed over the center recess. A motor may be disposed within the internal cavity of the body, between the top cover and the bottom cover. In some embodiments, disposing a motor within the internal cavity may comprise mounting, positioning, or otherwise affixing the motor within the internal cavity. A ceiling attachment or a downrod may be secured to the top cover of the body. In some embodiments, curvilinear segments of the top cover and curvilinear segments of the bottom cover may comprise corresponding curvatures. In some embodiments, a plane of the fan blade may be aligned oblique to a rotational plane of the ceiling fan.

In some embodiments, the fan blade may further comprise a fan blade recess extending through the fan blade. The bottom cover of the body may further comprise a peg configured to be secured within the fan blade recess. The top cover of the body may further comprise a pin configured to be secured within the fan blade recess. The top cover of the body may further comprise a fastener opening configured to receive a fastener therein. Said fastener may be fastened through and secured against the fastened opening of the top cover and then further fastened and secured against a fastener opening in the bottom cover of the body.

Another aspect of the present disclosure provides for a method of assembling a ceiling fan. The method may comprise providing a bottom cover of a body, the bottom cover comprising a peg. The method may further comprise providing a fan blade comprising a fan blade recess. The method may further comprise securing the peg of the bottom cover within the fan blade recess. The method may further comprise providing a top cover of the body, the top cover comprising a pin. The method may further comprise aligning the pin with at least a portion of the fan blade recess. The method may further comprise securing the pin of the top cover within the fan blade recess. In some embodiments, the top cover and the bottom cover may form an internal cavity therebetween. In some embodiments, curvilinear segments of the top cover may contour against curvilinear segments of the bottom cover.

In some embodiments, the bottom cover of the body may comprise a center recess. A cover panel may be disposed over the center recess. A motor may be within the internal cavity of the body. In some embodiments, the body may comprise a substantially discoidal geometry. In some embodiments, the body may comprise a substantially oblate spheroid geometry. In some embodiments, a plane of the fan blade may be aligned oblique to a rotational plane of the ceiling fan. In some embodiments, the method may further comprise securing a ceiling attachment to the top cover of the body. The method may further comprise securing the ceiling fan to a ceiling. The method may further comprise securing a fastener through a fastener opening of the top cover of the body.

BRIEF DESCRIPTION OF THE DRAWINGS

Some embodiments of the disclosure may be understood by referring, in part, to the present disclosure and the accompanying drawings, wherein.

DETAILED DESCRIPTION

The present disclosure relates, according to some embodiments, to devices, systems, methods of making, and methods of assembling, ceiling fans. Features of the present disclosure are shown in the accompanying figures. Embodiments of the present disclosure may be best understood by one of ordinary skill in the art with reference to the accompanying figures and the description herein.

Figure 1A:
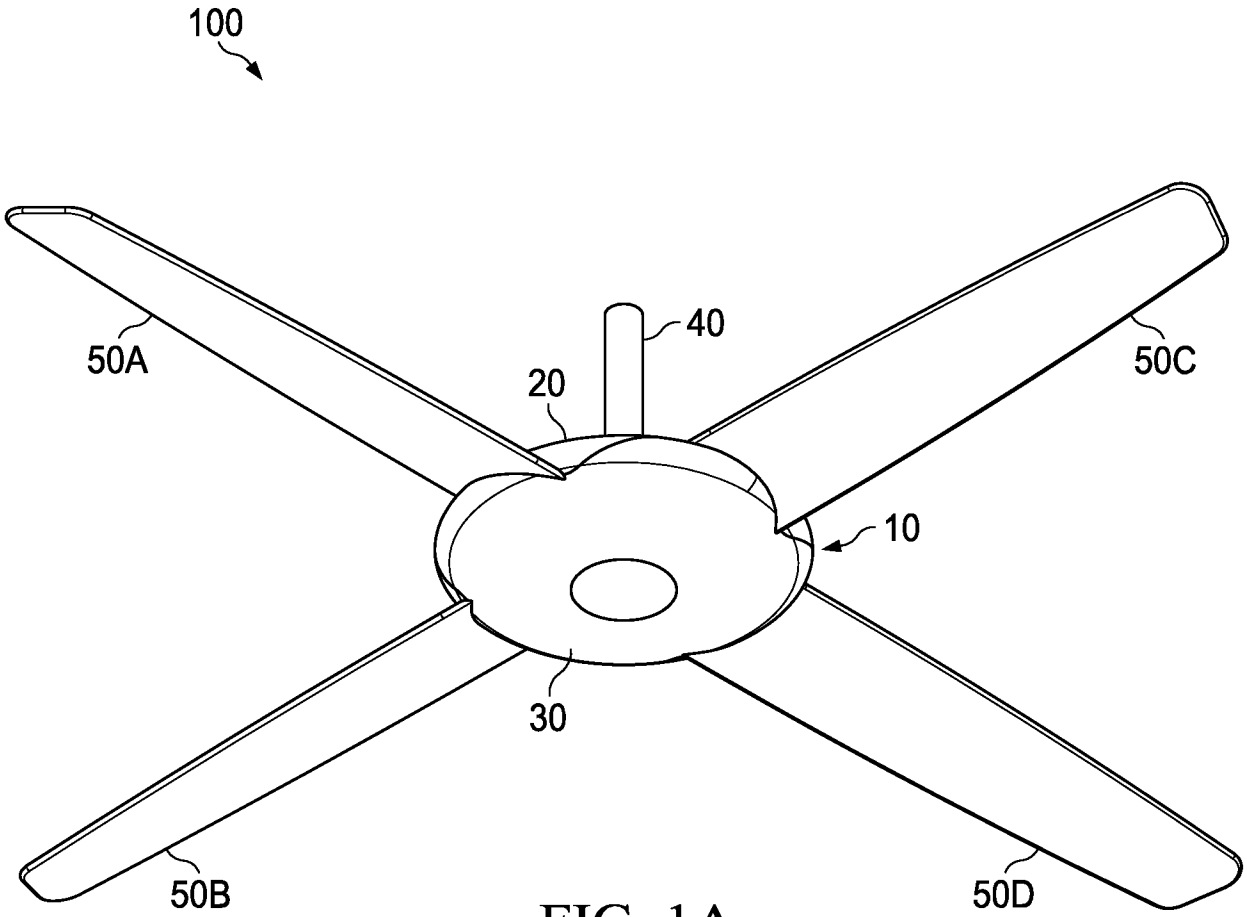
FIG. 1A illustrates a perspective view of a ceiling fan according to one embodiment of the present disclosure.
Figure 1B:
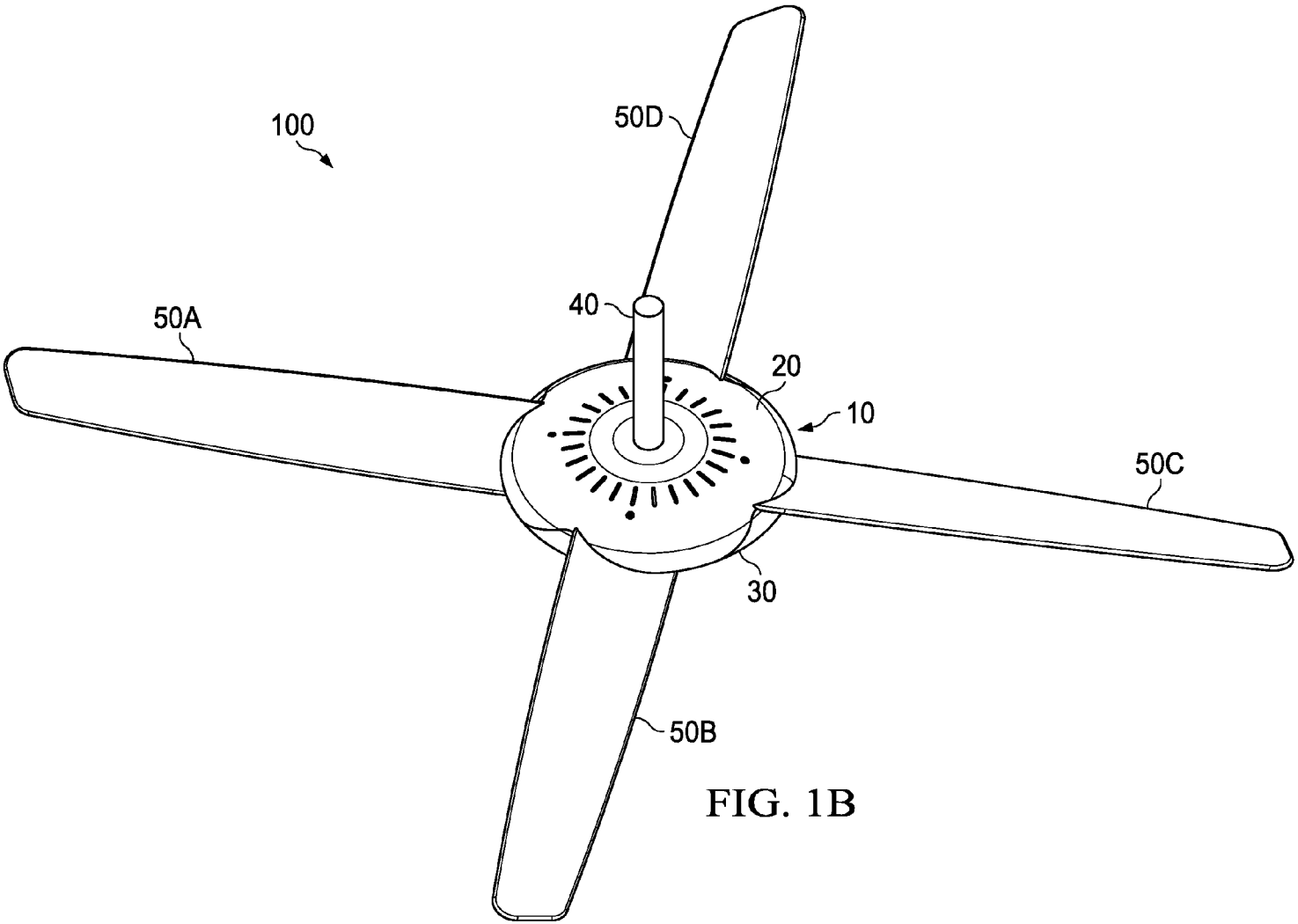
FIG. 1B illustrates another perspective view of a ceiling fan according to one embodiment of the present disclosure.

FIG. 1A and FIG. 1B illustrate perspective views of a ceiling fan according to example embodiments of the present disclosure. As shown in FIG. 1A and FIG. 1B, a ceiling fan 100 of the present disclosure may generally comprise a body 10, a downrod 40, and a plurality of fan blades 50A, 50B, 50C, 50D. Described further, the body 10 may comprise a top cover 20 and a bottom cover 30.

In some embodiments, the downrod 40 may be a separate component secured to the top cover 20 of the body. In some embodiments, the downrod 40 may be monolithic with the top cover 20 of the body 10. The downrod 40 may advantageously allow for the ceiling fan 100 to be secured to a ceiling. As shown in FIG. 1A and FIG. 1B, the downrod 40 may comprise a cylindrical geometry. However, other appropriate geometries may be used without departing from the scope of the present disclosure. The dimensions of the downrod 40 may be varied as needed to achieve different objectives. For example, the length of the downrod 40 may be increased or decreased to dispose the body 10 further from or closer to the ceiling. As another example, the thickness or circumference of the downrod 40 may be varied to increase or decrease the weight or stability of the ceiling fan 100. Numerous structural variations may also be achieved by altering the dimension of the downrod 40.

In some embodiments, the downrod 40 may comprise or be part of a ceiling fan attachment. Thus, embodiments of the present disclosure may comprise a ceiling fan 100 comprising a ceiling attachment, such as the downrod 40, secured to the top cover 20 of the body 10.

The top cover 20 and the bottom cover 30 may each comprise a disc-like geometry. The top cover 20 and the bottom cover 30 may contour against each other or may be assembled in a manner that may advantageously provide for a compact and smooth body 10. In some embodiments, the top cover 20 and the bottom cover 30 may form a body 10 that comprises a substantially discoidal geometry. In some embodiments, the top cover 20 and the bottom cover 30 may form a body 10 that comprises a substantially oblate spheroid geometry. The discoidal geometry and/or the oblate spheroid geometries may be the result of a clamshell structure of the top cover 20 and the bottom cover 30 of the body 10. Said geometries may advantageously provide for greater ease in assembly, fewer overall components, and other structural benefits in a ceiling fan assembly.

The ceiling fan 100 may comprise one or more fan blades 50A, 50B, 50C, 50D. As shown in FIG. 1A and FIG. 1B, embodiments of the present disclosure may comprise four fan blades 50A, 50B, 50C, 50D. However, the number of fan blades may be varied without departing from the scope of the present disclosure. In some embodiments, the ceiling fan may have only one fan blade. In some embodiments, the ceiling fan 100 may have two, three, five, six, or more fan blades as desirable or advantageous to achieve various structural or functional goals. For example, a larger number of fan blades may advantageously promote greater air circulation. As another example, a smaller number of fan blades may advantageously provide for a lighter ceiling fan 100.

Figure 2A:
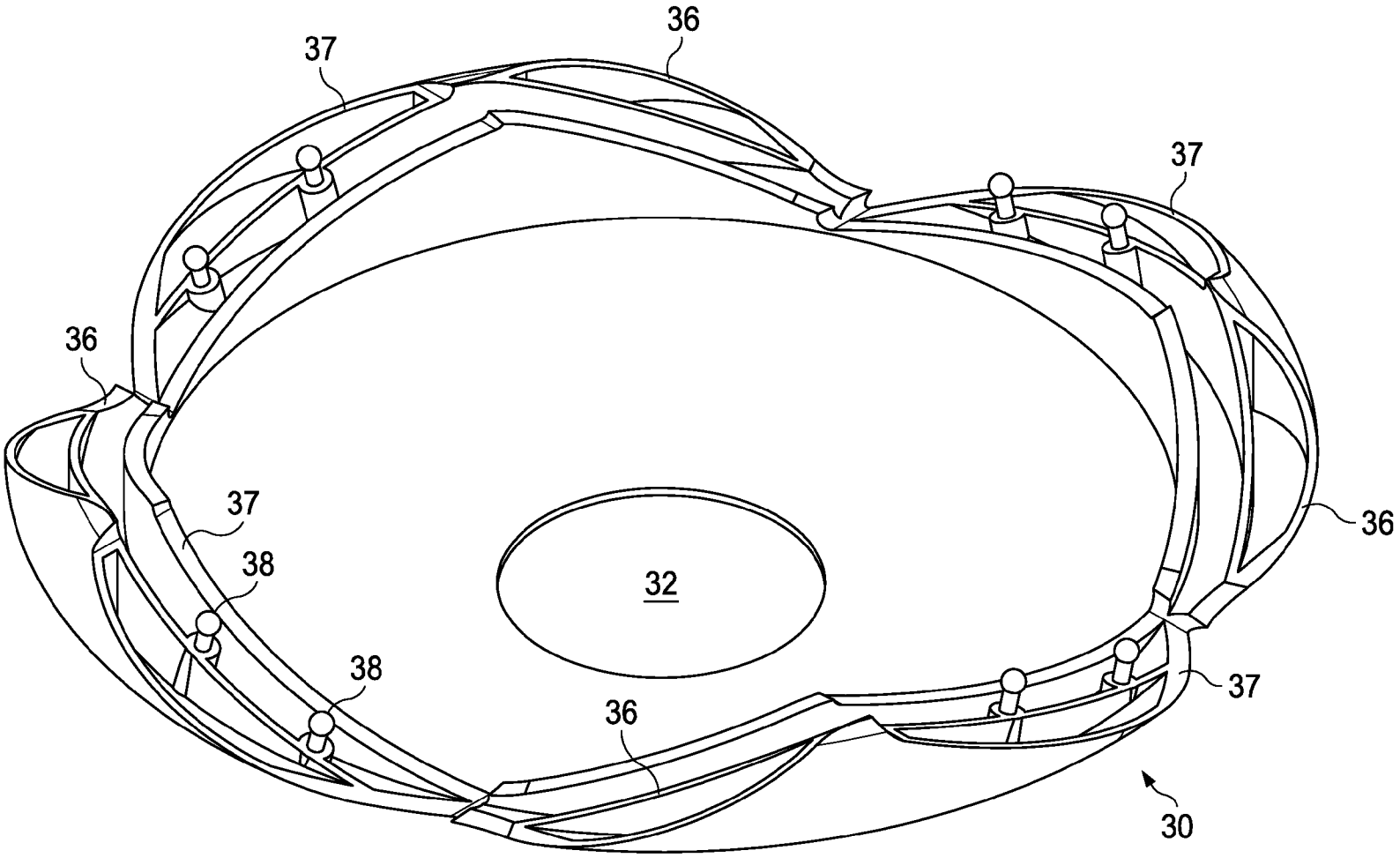
FIG. 2A illustrates a perspective view of a bottom cover of a body of a ceiling fan according to one embodiment of the present disclosure.
Figure 2B:
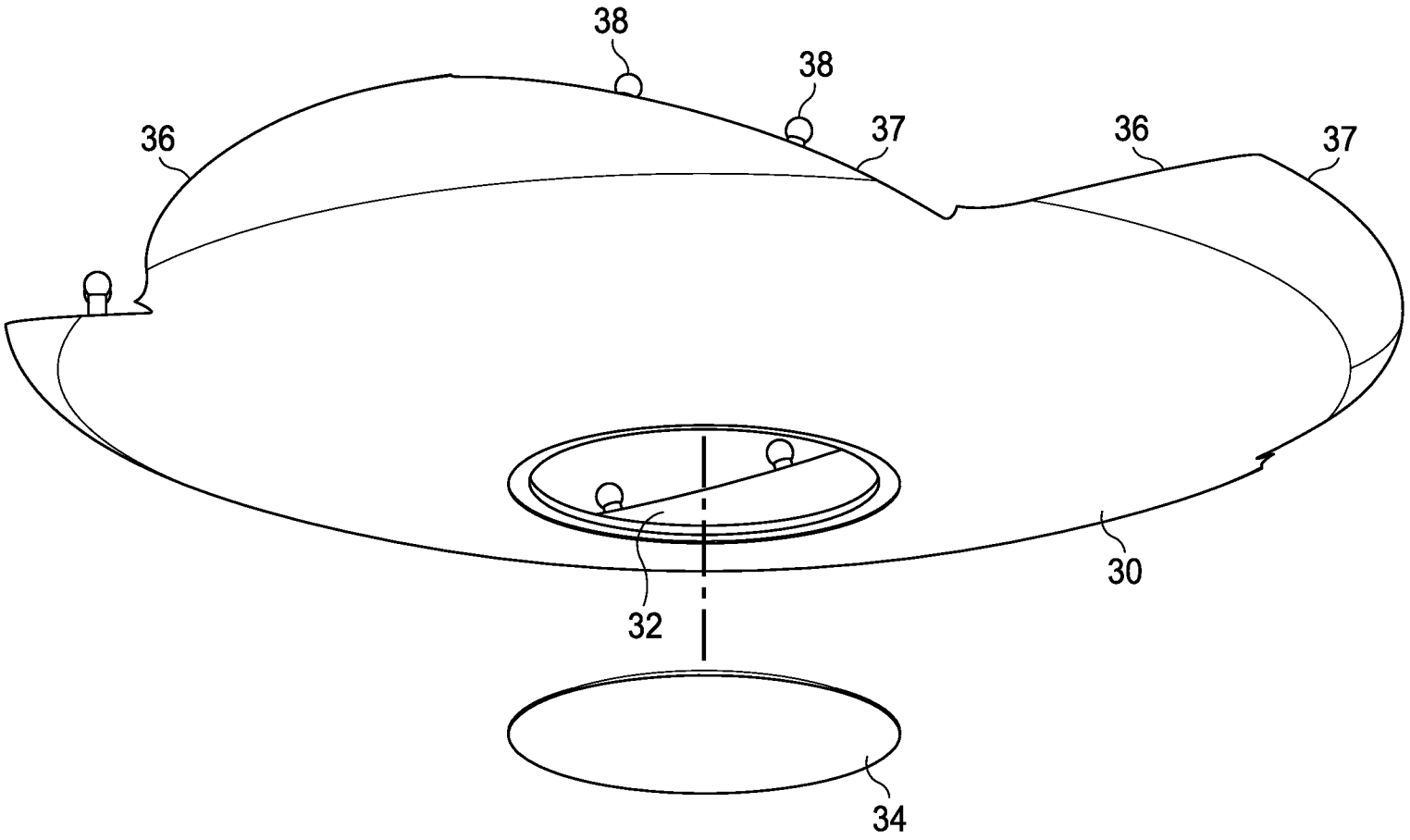
FIG. 2B illustrates another perspective view of a bottom cover of a body of a ceiling fan according to one embodiment of the present disclosure.
Figure 2C:
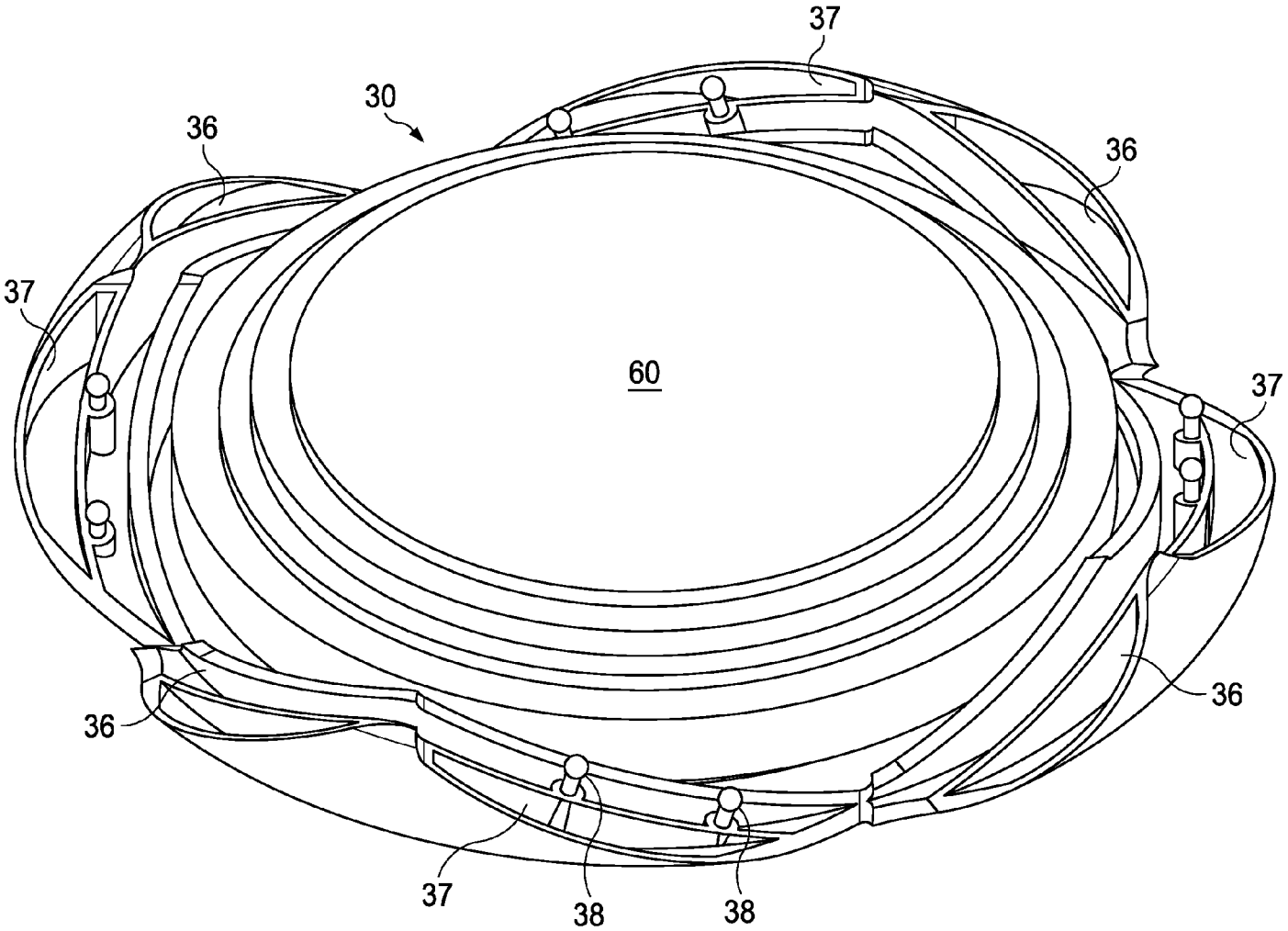
FIG. 2C illustrates another perspective view of a bottom cover of a body of a ceiling fan according to one embodiment of the present disclosure.

FIG. 2A, FIG. 2B, and FIG. 2C shows example embodiments of the bottom cover 30 of the body 10 of the ceiling fan 100. As shown in FIG. 2A, FIG. 2B, and FIG. 2C, the bottom cover 30 may comprise a disc-like geometry with curved edges. Explained further, the bottom cover 30 may comprise a section that is substantially disc-like, wherein the rim or edge of the disc-like geometry may be curved or protruded. The curvatures and dimensions of the rim or edge may be varied to meet various structural needs.

As shown in FIG. 2A, the bottom cover 30 of the body 10 may comprise a center recess 32. The center recess 32 may comprise a hole, cut-out, or cavity in the surface of the bottom cover 30. The center recess 32 may advantageously allow for manipulation of components within the body 10 of the ceiling fan 100 without the need to disassemble the ceiling fan 100 or separate the ceiling fan 100 from a ceiling. The spacing provided by the cavity of the center recess 32 may advantageously allow a light kit or other components to be disposed therein. Explained further, a light kit may be disposed or otherwise secured within the center recess 32 of the bottom cover 30 of the body 10 of the ceiling fan 100. Accordingly, a light may be emitted downward from the ceiling fan 100.

In other embodiments, a light kit or other components may not be present in the center recess 32. For such embodiments, it may be advantageous to cover the center recess 32. As shown in FIG. 2B, a cover panel 34 may be disposed over or within the center recess. The cover plate 34 may be a disc-like or discoidal plate. In some embodiments, the center panel 34 may comprise a threading along an outer edge that may be secured against a corresponding threading along an edge of the center recess 32. Other attachment or securing means such as clips or fasteners may be used to secure the center panel 34 to the center recess 32 without departing from the scope of the present disclosure.

As shown in FIG. 2C, a motor 60 may be disposed against the bottom cover 30. In some embodiments, the motor 60 may be disposed between the top cover 20 and the bottom cover 30 when the ceiling fan 100 is assembled. Thus, the motor 60 may advantageously be completely or substantially hidden from view when the ceiling fan 100 is assembled.

The bottom cover 30 of the body 10 may comprise a disc-like geometry with curved edges. The curved edge or rim may comprise separate sections. Some sections may be a fan blade interface section 37 configured to allow a fan blade 50A, 50B, 50C, 50D to be secured thereon. As shown in FIG. 2A, FIG. 2B, and FIG. 2C, fan blade interface section 37 may comprise a securing feature 38 disposed thereon. One of ordinary skill in the art would appreciate that securing feature 38 may be a peg, a screw, or other suitable mechanical feature. In some embodiments, securing feature 38 may comprise a spherical head portion and an elongated cylindrical body portion, wherein the elongated cylindrical body portion may comprise an external threading thereon. In some embodiments, securing feature 38 may be a separate component secured onto the fan blade interface section 37. For example, securing feature 38 may comprise a body with a fastening thread thereon. The fastening thread of a securing feature 38 may then be secured into a corresponding fastening thread in a depression or threading cavity within the bottom cover 30. In some embodiments, securing feature 38 may be monolithic with the bottom cover 30 of the body 10, and additional assembly of the securing feature 38 to the bottom cover 30 may not be required.

As shown in FIG. 2A, FIG. 2B, and FIG. 2C, the bottom cover 30 may comprise a plurality of fan blade interface sections 37. Each fan blade interface section 37 may comprise at least one securing feature 38. In some embodiments, each fan blade interface section 37 may comprise two securing features 38 disposed thereon. In FIG. 2A, FIG. 2B, and FIG. 2C, two securing features 38 are shown disposed on a fan blade interface section 37. Such illustration is provided by way of example only. Additional securing features 38 may be disposed on the fan blade interface sections 37 shown in FIG. 2A, FIG. 2B, and FIG. 2C. The number of securing features 38 disposed on the bottom cover 30 may be varied to achieve certain advantages. For example, a greater number of securing features 38 may advantageously help promote stability of a fan blade 50 against the fan blade interface sections 37. In contrast, a lesser number of securing features 38 may advantageously help promote greater ease in assembling a fan blade 50 on the fan blade interface sections 37.

As explained, the curved edge or rim may comprise separate sections. Some sections may be a segment 36 that may not be configured to interface with a fan blade 50. Instead, segment 36 of the bottom cover 30 may be configured to interface and/or contour against a corresponding segment of the top cover 20 of the ceiling fan 100. Segment 36 of the bottom cover 30 and a corresponding segment of the top cover 20 may be curvilinear and may comprise corresponding curvatures. Segment 36 of the bottom cover 30 and a corresponding segment of the top cover 20 may each comprise a curvature such that the two segments may easily or smoothly contour against one another when the top cover 20 is assembled over the bottom cover 30.

Figure 3A:
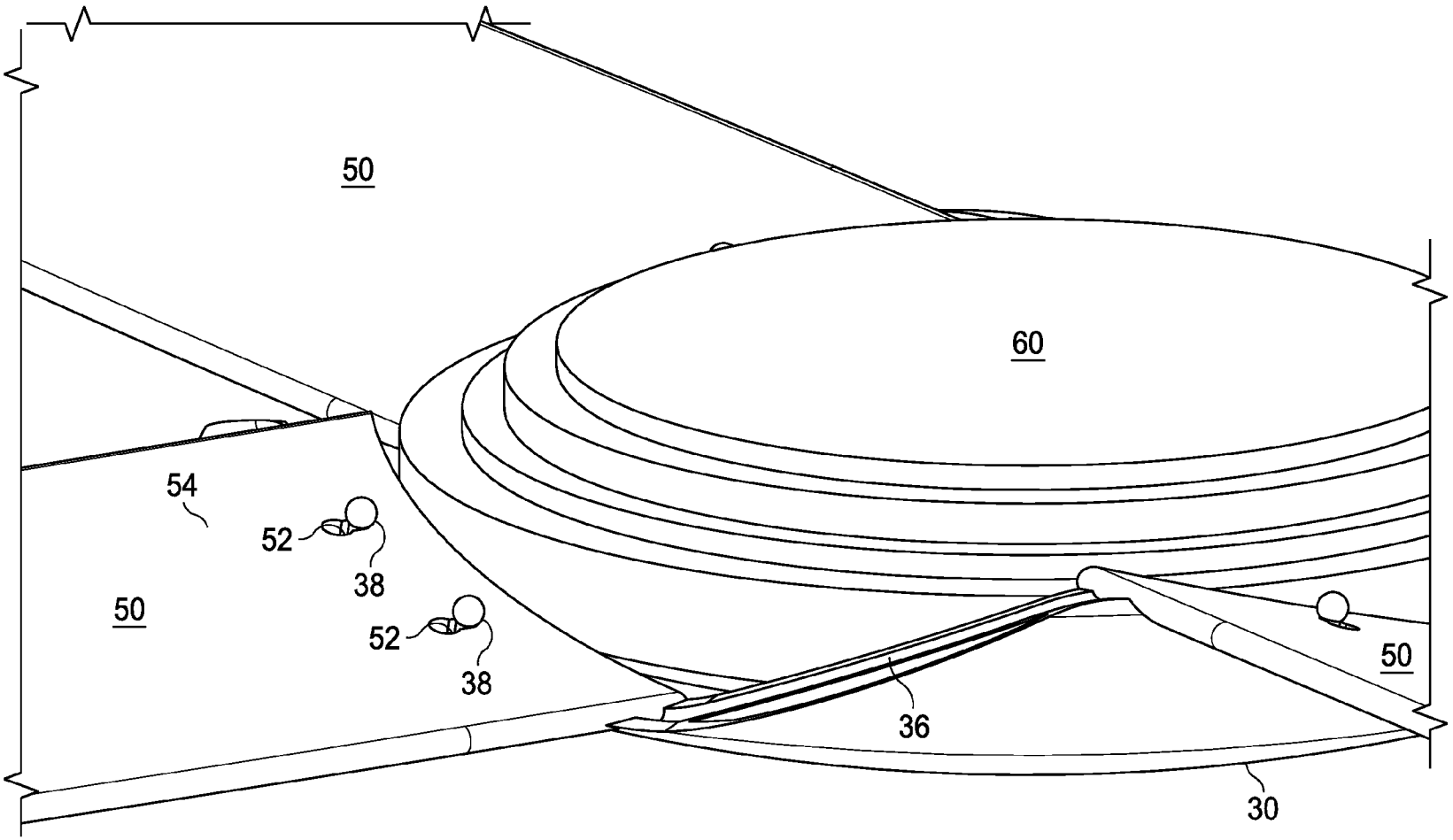
FIG. 3A illustrates another perspective view of a fan blade secured to a bottom cover of a body of a ceiling fan according to one embodiment of the present disclosure.
Figure 3B:
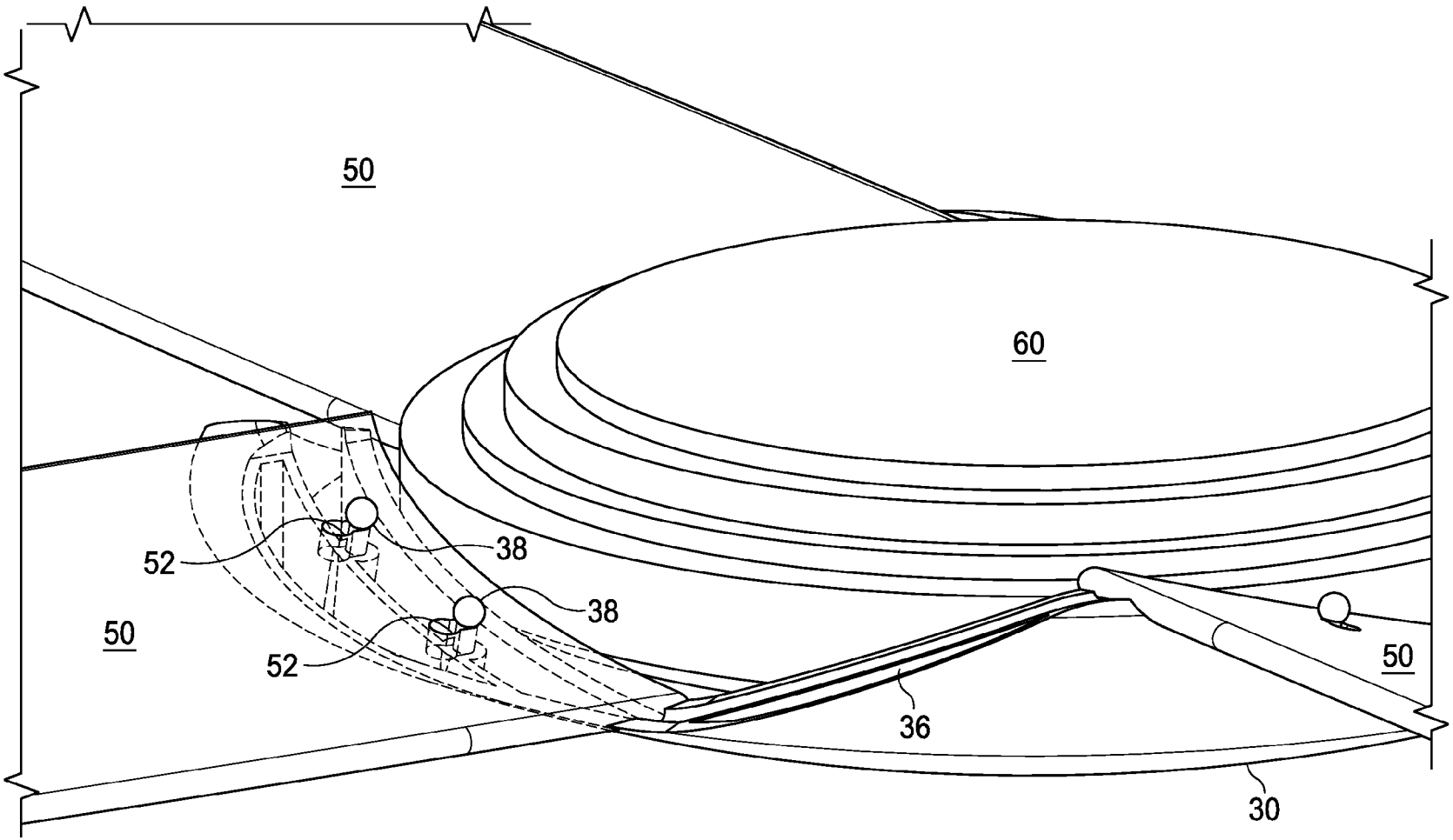
FIG. 3B illustrates a see-through perspective view of a fan blade secured to a bottom cover of a body of a ceiling fan according to one embodiment of the present disclosure.
Figure 3C:
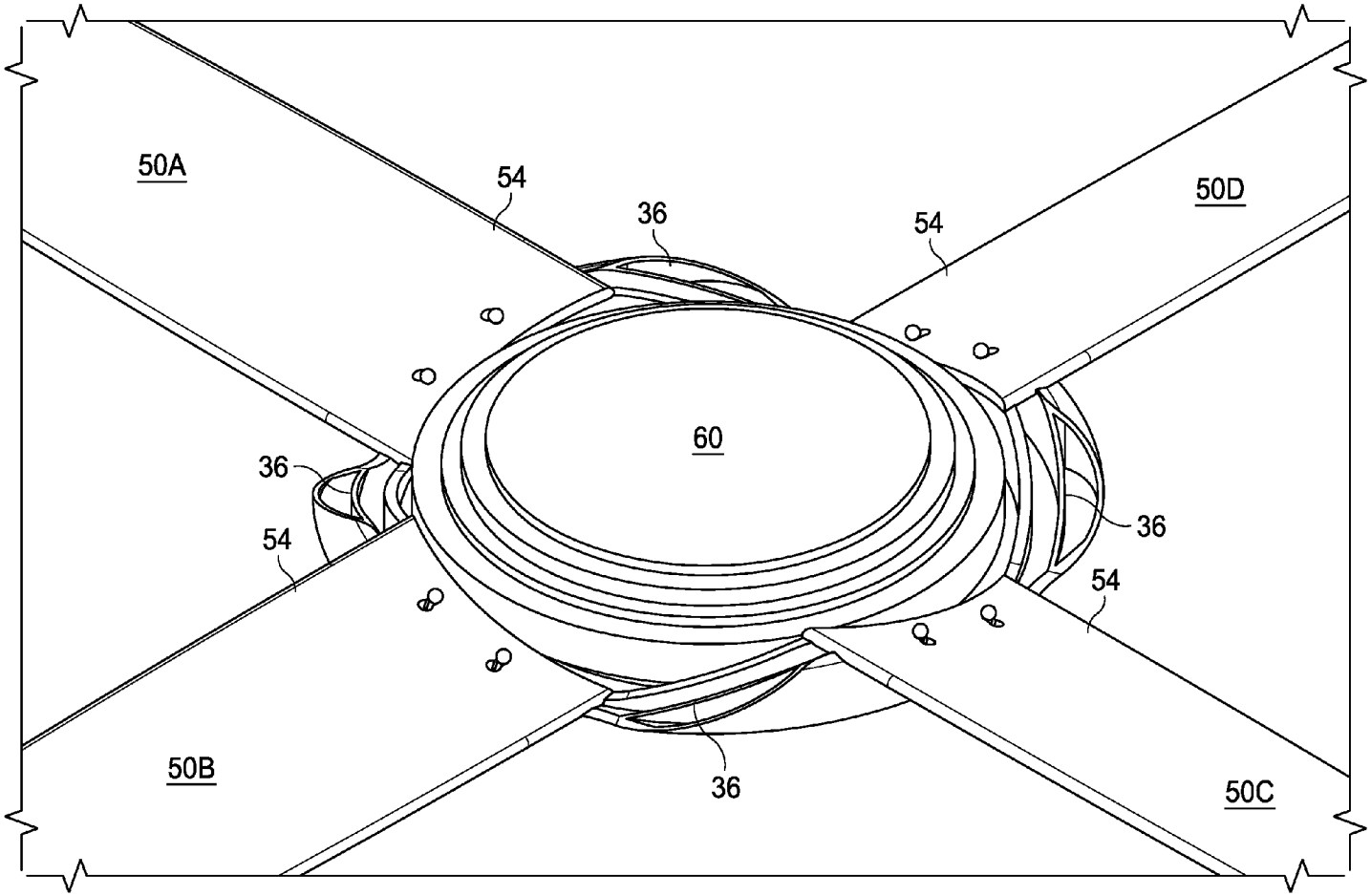
FIG. 3C illustrates a perspective view of a plurality of fan blades secured to a bottom cover of a body of a ceiling fan according to one embodiment of the present disclosure.

FIG. 3A, FIG. 3B, and FIG. 3C illustrate perspective views of a fan blade 50 secured to the bottom cover 30 of the body 10 of the ceiling fan 100 according to one embodiment of the present disclosure. As shown in FIG. 3A and FIG. 3B, fan blade 50 may comprise a securing end 54. The securing end 54 may be configured to be secured against the body 10 such that at least a portion of the fan blade rests within the body 10. At least a portion of the securing end 54 may be disposed between the bottom cover 30 and the top cover 20 of the body 10.

The securing end 54 may comprise at least one fan blade recess 52 therein. For example, as seen in FIG. 3A and FIG. 3B, fan blade 50 may comprise two fan blade recesses 52 at the securing end 54. Embodiments of the present disclosure may advantageously provide for fan blade recesses 52 comprising particular geometries. Said geometries may promote an easy or convenient but secure attachment and assembly between the fan blade 50, the top cover 20, and the bottom cover 30.

In some embodiments, the fan blade recess 52 may comprise a geometry of two cylindrical regions. The two cylindrical regions may or may not overlap. The two cylindrical regions that make up the fan blade recess 52 may comprise differing sizes or radiuses. At least one of the cylindrical regions that make up the fan blade recess 52 may be configured to secure the securing feature 38 of the bottom cover 30 of the body 10 of the ceiling fan 100 therein. The securing feature 38 may be secured within the fan blade recess 52 through various methods.

In some embodiments, the fan blade recess 52 may be aligned over a depression or threading cavity within the bottom cover 30. Described further, at least one of the cylindrical regions of the fan blade recess 52 may align with a depression of the bottom cover 30. The alignment may advantageously allow the securing feature 38 to be lowered or secured into a channel formed by the aligned cylindrical religion and depression. For example, the securing feature 38 may be fastened into the channel via a threading on an elongated body portion of the securing feature 38. Said threading may be secured against a corresponding threading in either the cylindrical region of the fan blade recess 52, the depression of the bottom cover 30, or both. A spherical head portion of the securing feature 38 may advantageously promote stability and security of the securing feature 38 disposed within the cylindrical cavity of the fan blade recess 52 and the depression of the bottom cover 30.

In some embodiments, the geometry of the fan blade recess 52 may comprise two overlapping cylindrical regions, wherein a first cylindrical region may comprise a greater radius than a second cylindrical region. The securing feature 38 may be received into the fan blade recess 52 along the first cylindrical region comprising a greater radius. Then, after being received into the first cylindrical region, the securing feature 38 may be slid into the second cylindrical region with a smaller radius. The spherical head portion of the securing feature 38 may have a diameter greater than that of the second cylindrical region. Accordingly, the securing feature 38 disposed within the second cylindrical region may be substantially limited in movement. The greater diameter of the spherical head portion of the securing feature 38 may prevent the fan blade 50 from being removed from the body cover 30 by simply lifting the fan blade 50. Though not limited to particular embodiments, such method of securing the fan blade 50 to the bottom cover 30 may be particularly advantageous when the securing feature 38 is monolithic with the bottom cover 30 of the body 10.

As shown in FIG. 3C, a plurality of fan blades 50A, 50B, 50C, 50D may be secured against or on the bottom cover 30. Four fan blades 50A, 50B, 50C, and 50D are shown in FIG. 3C by way of example. Ceiling fan 100 may comprise any number of fan blades 50A, 50B, 50C, 50D. For example, the ceiling fan 100 may comprise one, two, three, four, five, six, or more fan blades 50 secured between the bottom cover 30 and the top cover 20 of the body 10. The number of fan blades 50A, 50B, 50C, 50D may be varied to achieve various structural or functional goals. For example, a larger number of fan blades may advantageously help promote greater air circulation. As another example, a smaller number of fan blades may advantageously help provide a lighter ceiling fan 100.

As shown in FIG. 3C, the plurality of fan blades 50A, 50B, 50C, 50D may be disposed equidistant from each another around the bottom cover 30 of the body 10. Each fan blade 50A, 50B, 50C, 50D may be separated from another fan blade 50A, 50B, 50C, 50D by a segment 36. Segment 36 may be curvilinear. Each segment 36 may have the same or different lengths. As shown, segment 36 may comprise a curvature thereon. As previously explained, a curvature of a segment 36 of bottom cover 30 may contour against a corresponding curvature of a segment of the top cover 20 when assembled.

Figure 4:
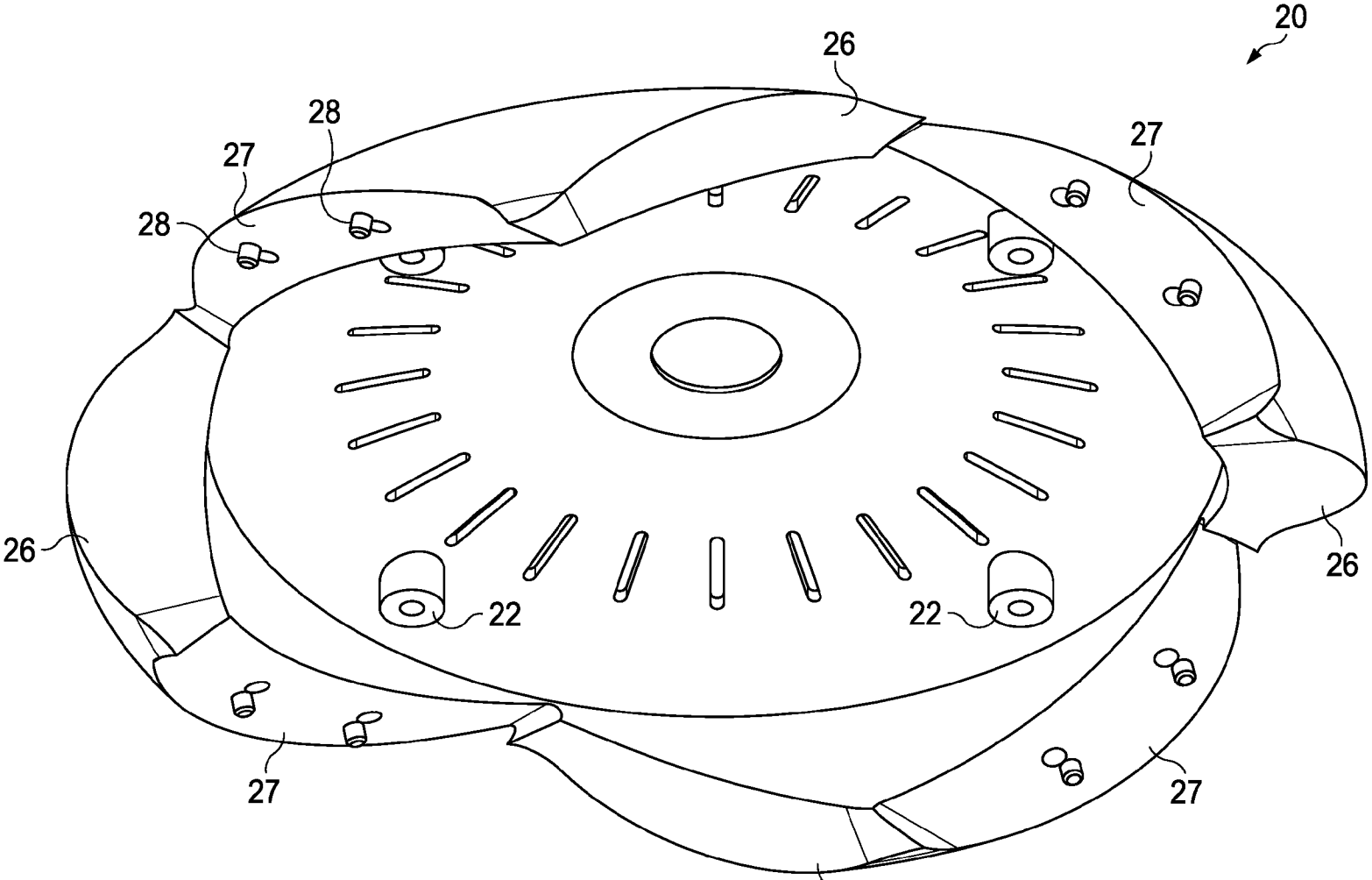
FIG. 4 illustrates a perspective view of a top cover of a body of a ceiling fan according to one embodiment of the present disclosure.

FIG. 4 illustrates a perspective view of a top cover 20 of a body 10 of a ceiling fan 100 according to one embodiment of the present disclosure. As shown in FIG. 4, the top cover 20 may comprise a disc-like geometry with curved edges. Explained further, the top cover 20 may comprise a section that is substantially disc-like, wherein the rim or edge of the disc-like geometry may be curved or protruded. The curvatures and dimensions of the rim or edge may be varied to meet various structural needs.

The curved edge or rim may comprise separate sections. Some sections may be a fan blade interface section 27 configured to allow a fan blade 50A, 50B, 50C, 50D to be secured thereon. The securing end 54 of the fan blade 50 may be secured between the fan blade interface section 27 of the top cover 20 and the fan blade interface section 37 of the bottom cover 30.

As shown in FIG. 4, the fan blade interface section 27 of the top cover 20 may comprise a pin 27 disposed thereon. Pin 27 may comprise a cylindrical body with particular dimensions such as a particular diameter and/or length. In FIG. 4, two pins 28 are shown disposed on each of the fan blade interface sections 27 of the top cover 20. Such illustration is provided by way of example only. Additional pins 28 may be disposed on all of the fan blade interface sections 27 shown in FIG. 4. The number of pins 28 disposed on the top cover 20 may be varied to achieve certain advantages. For example, a greater number of pins 28 may advantageously help promote a stability of a fan blade against the fan blade interface sections 27. In contrast, a lesser number of pins 28 may advantageously help promote greater ease in assembling a fan blade 50 on the fan blade interface sections 27.

Other sections of the curved edge or rim of the top cover 20 may comprise a segment 26 that may not be configured to interface with a fan blade 50. Instead, segment 26 of the top cover 20 may be configured to interface and/or contour against the segment 36 of the bottom cover 30 of the ceiling fan 100. Segment 26 of the top cover 20 and the segment 36 of the bottom cover 30 may be curvilinear and may comprise corresponding curvatures. Curvilinear segment 26 of the top cover 20 and curvilinear segment 36 of the bottom cover 30 may each comprise a curvature such that the two segments may easily or smoothly contour against one another when the top cover 20 is assembled on or over the bottom cover 30.

The top cover 20 may also comprise a fastener opening 22 configured to receive a fastener therein. The fastener opening 22 may comprise an internal thread to secure a fastener therein.

FIG. 5A, FIG. 5B, FIG. 5C, and FIG. 5D, illustrate perspective views of a top cover 20 assembled with the fan blade 50 and the bottom cover 30 of the ceiling fan 100.

Figure 5A:
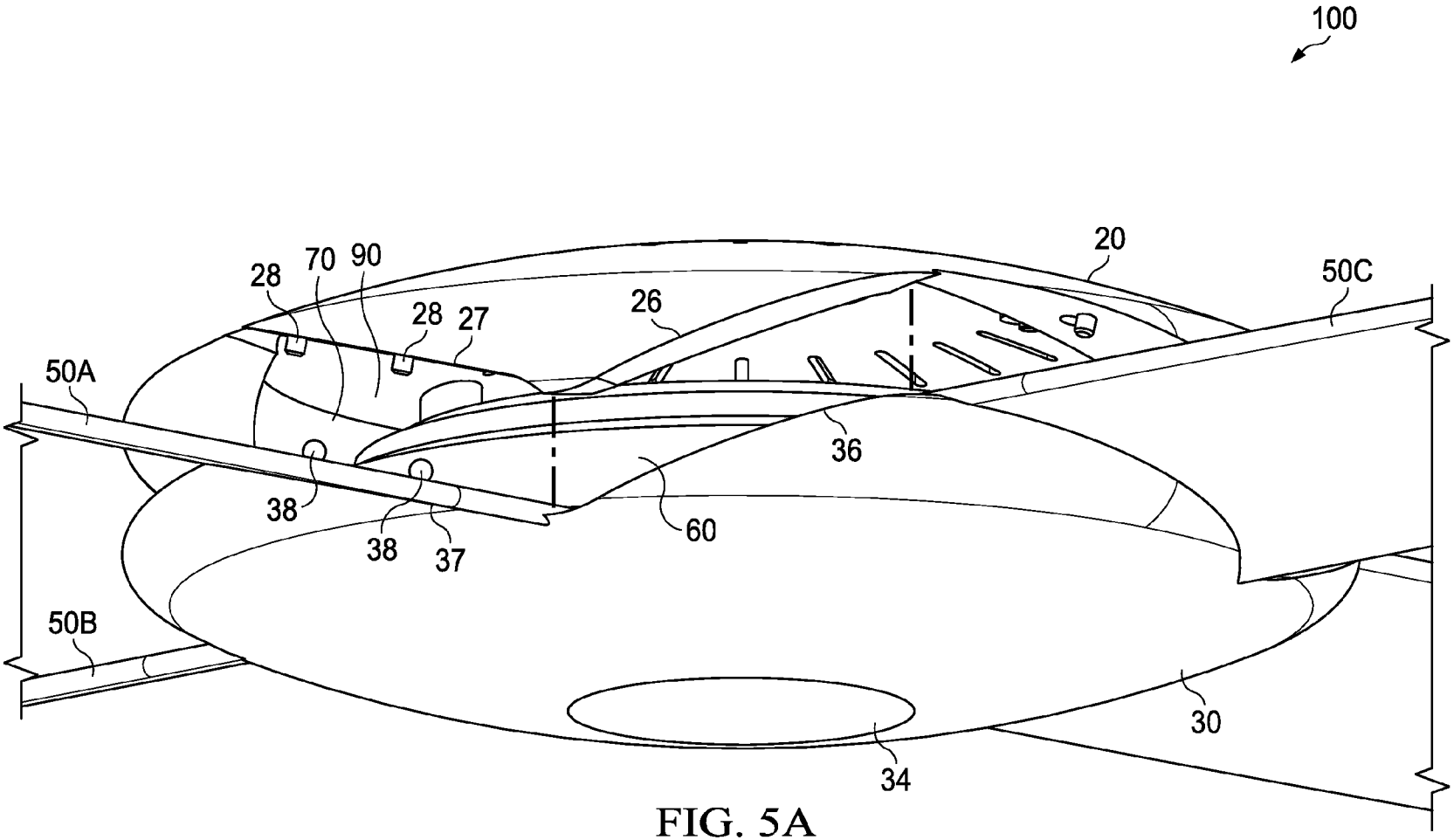
FIG. 5A illustrates a perspective view of a top cover of a body aligned over a bottom cover of a body of a ceiling fan according to one embodiment of the present disclosure.

As shown in FIG. 5A, the top cover 20 of the ceiling fan 100 may be aligned over the bottom cover 30 of the ceiling fan 100 with the fan blades 50A, 50B, 50C, 50D disposed or secured thereon. The top cover 20 may be aligned or positioned such that the pins 28 of the top cover 20 may align with or may be positioned over at least part of the fan blade recess 52. The fan blade recess 52 may comprise a geometry of two cylindrical regions. One of said two cylindrical regions may already be occupied by the securing features 38 of the bottom cover. Accordingly, the pins 28 may occupy or be disposed within the second or unoccupied cylindrical recess.

Figure 5B:
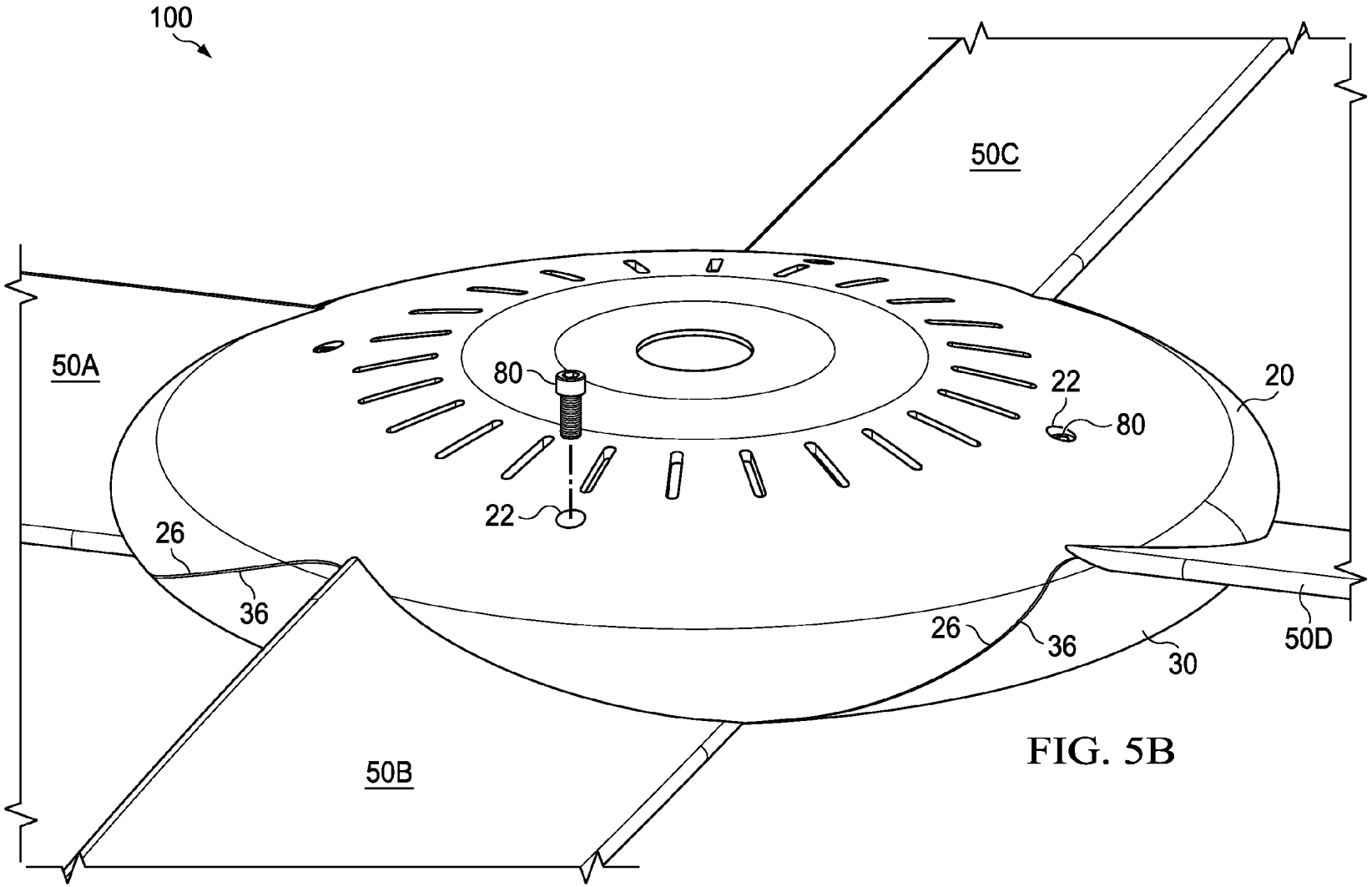
FIG. 5B illustrates another perspective view of a top cover of a body aligned over a bottom cover of a body of a ceiling fan according to one embodiment of the present disclosure.
Figure 5C:
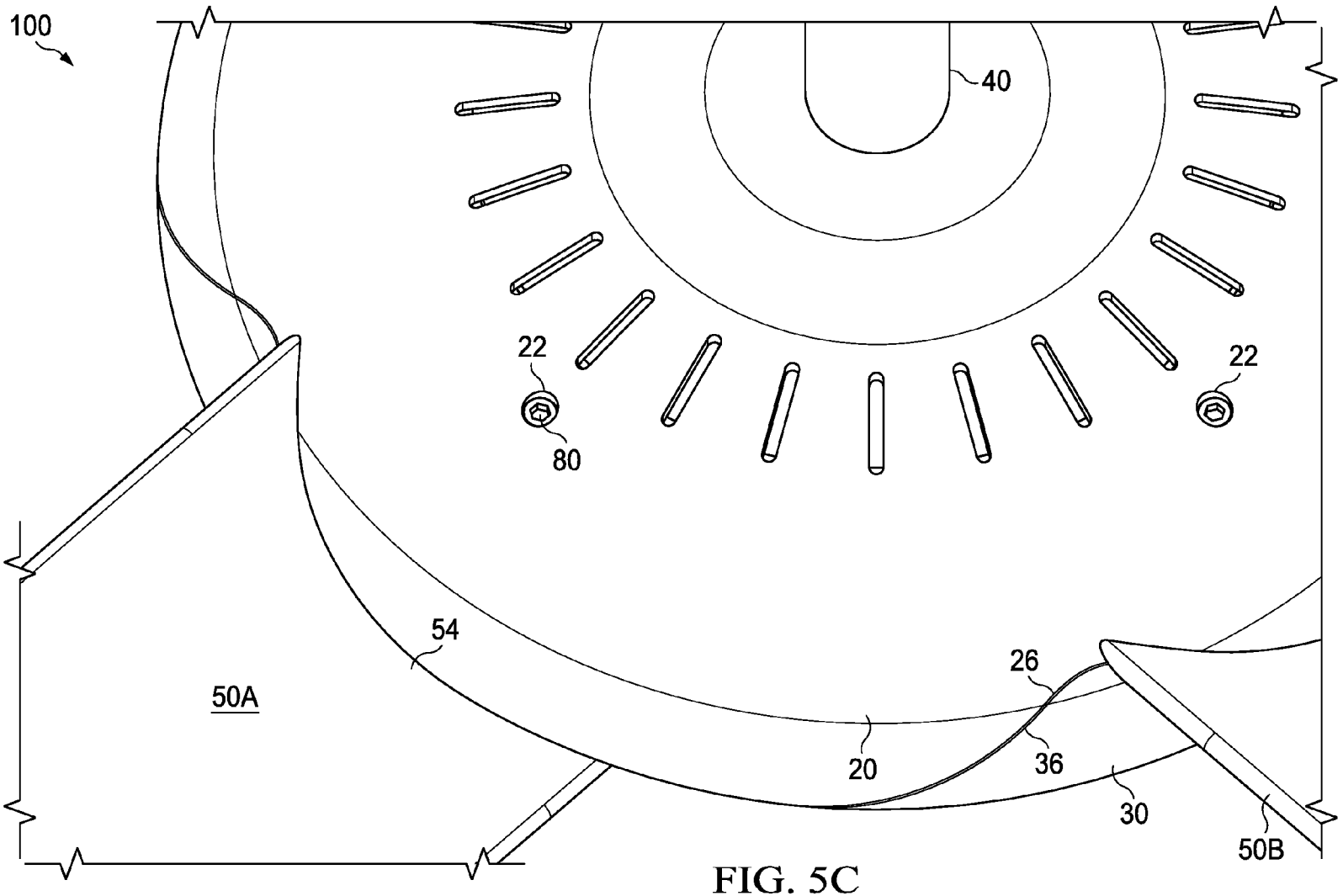
FIG. 5C illustrates a perspective view of a top cover of a body secured to a bottom cover of a body of a ceiling fan according to one embodiment of the present disclosure.
Figure 5D:
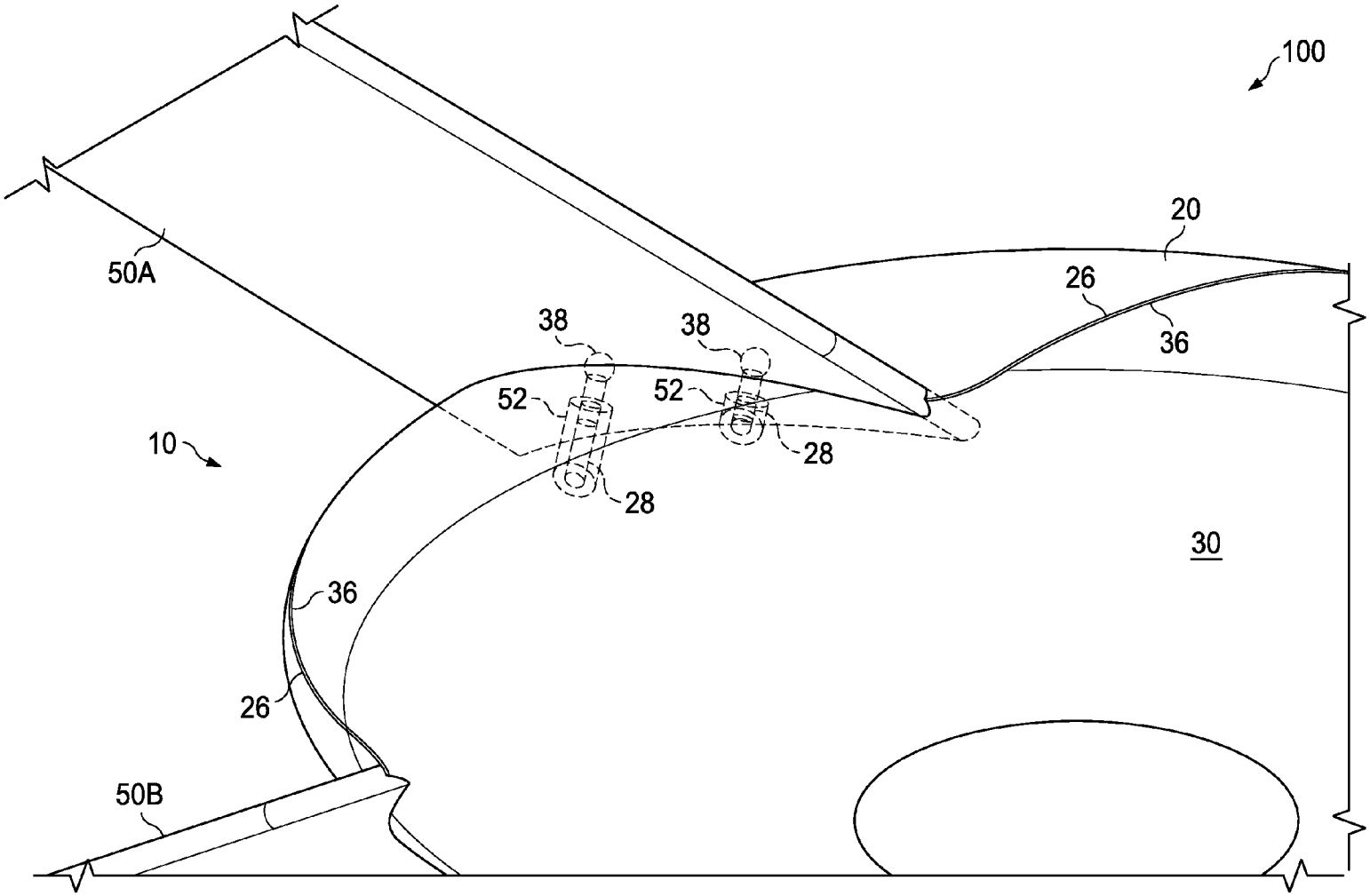
FIG. 5D illustrates a see-through perspective view of a top cover of a body secured to a bottom cover of a body of a ceiling fan according to one embodiment of the present disclosure.

As shown in the see-through view of FIG. 5D, the fan blade 50A may be secured between the top cover 20 and the bottom cover 30. Pins 28 of the top cover 20 and securing features 38 of the bottom cover 30 may be disposed within the fan blade recess 52 to thereby secure the position of the fan blade 50A. The spherical head portions of the securing features 38 may rest upon the top of the fan blade 50A. The spherical head portions of the securing features 38 may also bias against a surface of the fan blade 50A and thereby create added friction and security. The elongated cylindrical body portion of the securing features 38 may comprise external threading and may extend through the width of the fan blade 50A when secured.

As shown in FIG. 5A, the curvatures or shapes of the top cover 20 and the bottom cover 30 may create an internal cavity 70 when the top cover 20 is disposed on the bottom cover 30. The internal cavity 70 may advantageously allow for certain components to be housed therein. For example, the motor 60 may be housed within the internal cavity 70. Other components such as portions of a ceiling attachment or portions of a downrod 40, may also be disposed therein. Still other components such as a light kit or other circuitry may advantageously be secured within the internal cavity 70. The size and dimensions of the internal cavity 70 may be varied without departing from the present disclosure. Various advantages may be achieved by varying the size and/or dimensions of the internal cavity 70. For example, a smaller internal cavity 70 may advantageously allow for a more compact ceiling fan structure and provide other structural benefits. As another example, a larger internal cavity 70 may advantageously allow for more components to be disposed therein and may allow for greater functional uses of the ceiling fan 100.

As shown in FIG. 5A, the fan blade 50A may be secured between the fan blade interface section 27 of the top cover 20 and the fan blade interface section 37 of the bottom cover 30. Fan blade interface section 27 of the top cover 20 and the fan blade interface section 37 of the bottom cover 30 may form a lateral recess 90 therebetween. The lateral recess 90 may comprise a slot-like opening or cavity that may connect to the internal cavity 70. Said slot-like lateral recesses 90 may allow a fan blade 50 secured within the internal cavity 70 to extend outward through the lateral recess 90.

Lateral recess 90 may comprise various geometries. In some embodiments, the lateral recesses 90 may be substantially rectangular. In some embodiments, the lateral recess 90 may or may not be substantially orthogonal to an axis of the downrod 40. Lateral recess 90 may be disposed oblique to a rotational plane of the ceiling fan 100. For example, the lateral recess 90 may be tilted or be at an angle with respect to a vertical axis of the downrod 40. A tilted or angled lateral recess 90 may advantageously allow for a fan blade 50A, 50B, 50C, 50D to be assembled at an angle or oblique to a rotational plane of the ceiling fan 100. In some embodiments, the lateral recess 90 may comprise a curved geometry. A curved lateral recess 90 may advantageously be able to accommodate curved fan blades 50A, 50B, 50C, 50D. Other variations may be made to the size, shape and/or positioning of the lateral recesses 90 without departing from the scope of the present disclosure.

As shown in FIG. 5A, FIG. 5B, FIG. 5C, and FIG. 5D, segment 26 of the top cover 20 and segment 36 of the bottom cover 30 may be curvilinear and may comprise corresponding curvatures. When assembled, curvilinear segment 26 of the top cover 20 may contour against curvilinear segment 36 of the bottom cover 30.

As shown in FIG. 5B and FIG. 5C, a fastener 80 may be secured into the fastener opening 22. A fastener opening 22 may advantageously be disposed or placed near each region of the body 10 wherein a fan blade 50 may be secured. Such placement may advantageously promote increased security and stability of the fan blade 50 relative to the top cover 20 and the bottom cover 30. Increasing security and stability of the fan blade 50 relative to the top cover 20 and the bottom cover 30 may also advantageously promote stability of the entire ceiling fan 100.

The fastener 80 may be threaded and secured through the fastener opening 22 of the top cover 20. In some embodiments, the bottom cover 30 or other components within the internal cavity 70 may comprise an aligned opening with corresponding threading configured to receive a lower portion of the fastener 80 therein. Fastener 80 may enter through the fastener opening 22 of the top cover 20 and be threaded through, for example, both the fastener opening 22 of the top cover 20 and also a fastener receiver threading in the bottom cover 30.

Figure 7:
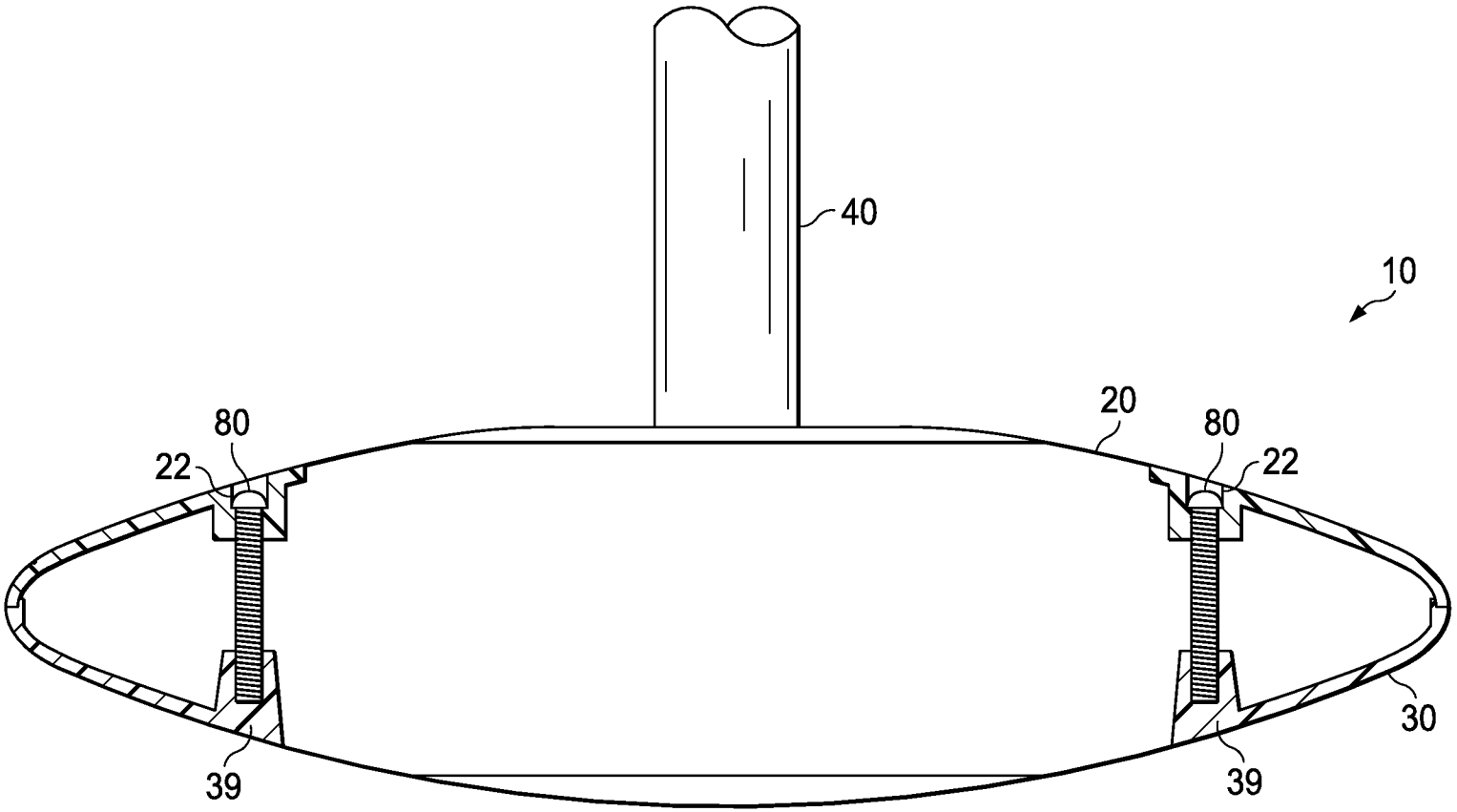
FIG. 7 illustrates a cross-sectional profile view of a ceiling fan according to one embodiment of the present disclosure.

For example, as shown in FIG. 7, fastener 80 may be secured to both the fastener opening 22 of the top cover 20 and a fastener receiver 39 of the bottom cover 30. Other components and features of the present disclosure have been omitted in FIG. 7 for additional clarity of the presently described features. By securing the fastener 80 through multiple components, such as the fastener opening 22 and the fastener receiver 39, the security and stability of the entire ceiling fan 100 may be advantageously increased.

Figure 6A:
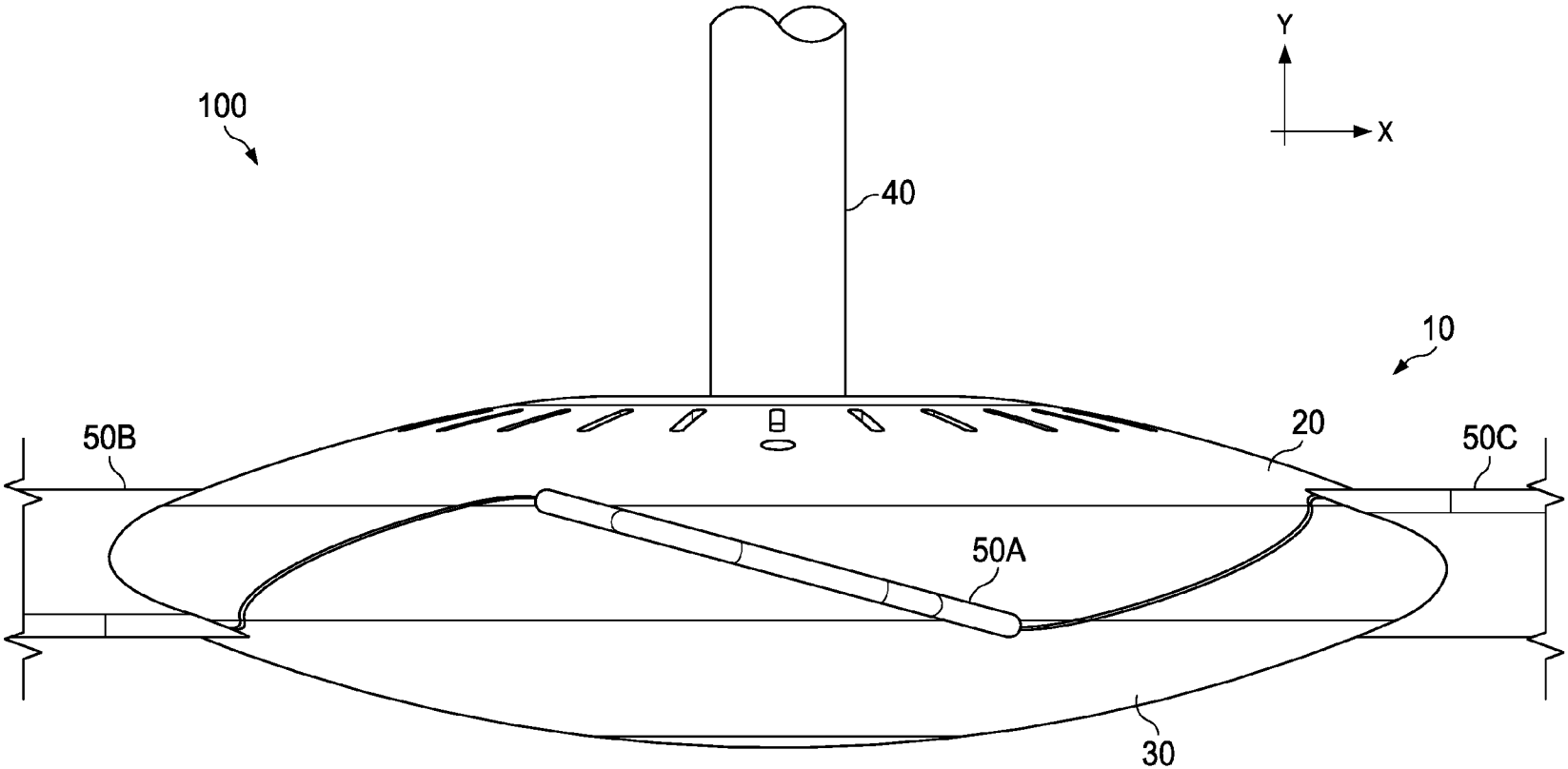
FIG. 6A illustrates a profile view of a ceiling fan according to one embodiment of the present disclosure.
Figure 6B:
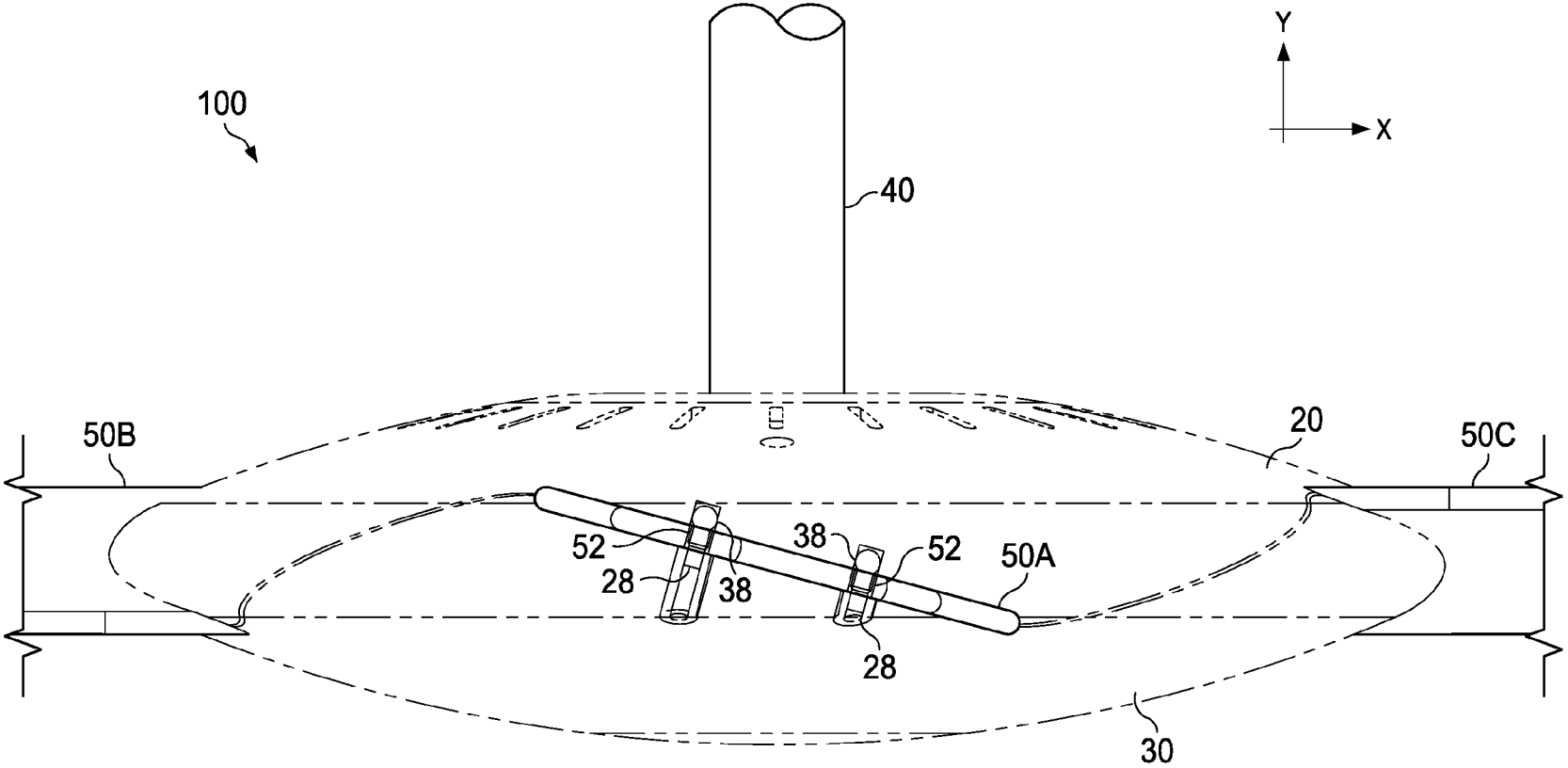
FIG. 6B illustrates a see-through profile view of a ceiling fan according to one embodiment of the present disclosure.

FIG. 6A and FIG. 6B illustrate profile views of a ceiling fan 100 according to example embodiments of the present disclosure. As shown in FIG. 6A and FIG. 6B, the fan blade 50A, 50B, 50C or a plane of the fan blade may not be aligned with a horizontal plane of the ceiling fan 100. The horizontal plane may be a plane defined by the X axis indicated in FIG. 6A and FIG. 6B. The plane defined by the X axis may be the rotational plane about which the fan blades 50A, 50B, 50C rotate. Using a different point of reference, it may be described that the fan blades 50A, 50B, 50C are not secured orthogonal to a vertical axis of the downrod 40. The vertical axis of the downrod may be the Y axis as indicated in FIG. 6A and FIG. 6B. The fan blades 50A, 50B, 50C may be secured oblique to a rotational plane of the ceiling fan 100 or oblique to the vertical axis of the downrod 40. The tilted angle of the fan blades 50A, 50B, 50C, 50D may advantageously promote better or more efficient air circulation by the ceiling fan 100.

As shown in the figures, fan blades 50A, 50B, 50C, 50D may comprise a slant or tilt from the horizontal plane of the ceiling fan 100. Said slant or tilt may be the same or different for each of the fan blades 50A, 50B, 50C, 50D.

In some embodiments, the fan blades 50A, 50B, 50C, 50D may comprise a curved structure. The curved structure of the fan blades 50A, 50B, 50C, 50D may advantageously promote better or more efficient air circulation by the ceiling fan 100.

In some embodiments, the fan blades 50A, 50B, 50C, 50D may comprise a securing end 54 (as shown in FIG. 3A and FIG. 3B) configured to be secured against the top cover 20 and the bottom cover 30 of the body 10 of the ceiling fan 100. In such configuration, the securing end 54 may rest at least partially within the internal cavity 70 (as shown in FIG. 5A) of the body 10. A portion of the securing end 54 of the fan blades 50A, 50B, 50C, 50D may comprise a corresponding geometry as the lateral recess 90 as spatially defined by the blade interface section 27 of the top cover 20 and the fan blade interface section 37 of the bottom cover 30. A curved lateral recess 90 may allow a fan blade 50A, 50B, 50C, 50D with a corresponding curvature at the securing end 54 to extend through said lateral recess 90.

In some embodiments, the lateral recess 90 may comprise a slightly larger opening than that of the dimensions of the securing end 54 of the fan blades 50A, 50B, 50C, 50D. The slightly larger opening may facilitate greater ease in the fan blade 50A, 50B, 50C, 50D extending through the lateral recess 90.

Features and components of the present disclosure may have various dimensions. Said dimensions may be varied without departing from the scope of the present disclosure. In some embodiments, the body 10, the top cover 20, and the bottom cover 30 may comprise diameters of about 280 mm. In some embodiments, the body may have a thickness of about 75 mm. In some embodiments, the downrod 40 may have a diameter of about 26 mm. Such dimension are given by the way of example only and are not intended to be limiting.

As will be understood by those skilled in the art who have the benefit of the instant disclosure, other equivalent or alternative compositions, devices, methods, and systems for ceiling fans can be envisioned without departing from the description contained herein. Accordingly, the manner of carrying out the disclosure as shown and described is to be construed as illustrative only.

Figure 8B:
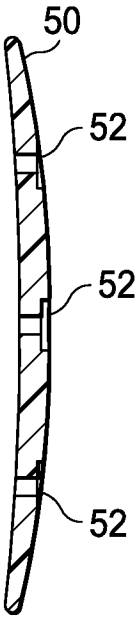
FIG. 8B illustrates another top-down view of a fan blade according to one embodiment of the present disclosure.
Figure 8A:
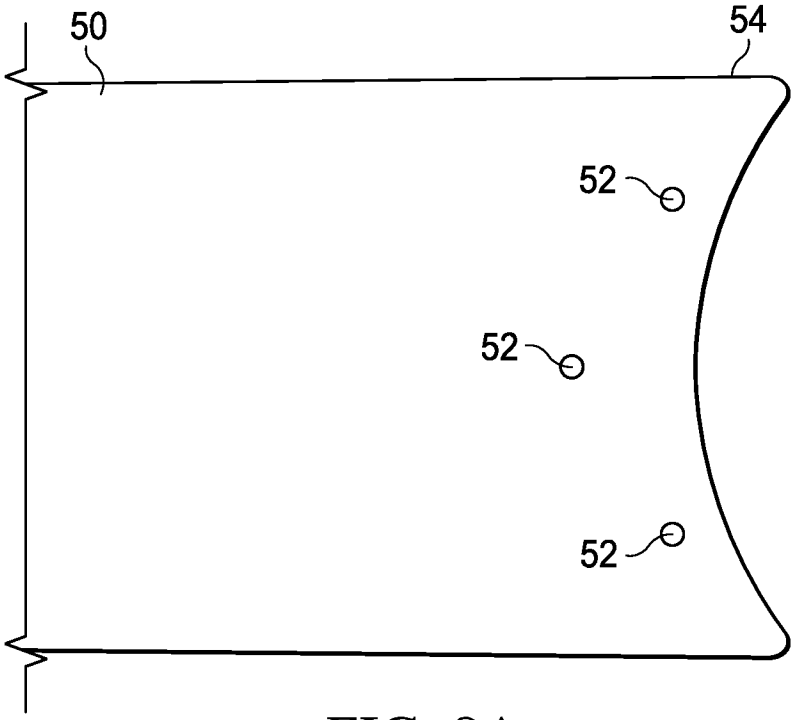
FIG. 8A illustrates a top-down view of a portion of a fan blade according to one embodiment of the present disclosure.

Persons skilled in the art may make various changes in the shape, size, number and/or arrangement of parts without departing from the scope of the instant disclosure. For example, the position and number of fan blades 50 may be varied. In some embodiments, securing features 38 or pins 28 may be interchangeable. As another example, the position and number of fan blade recesses 52 may be varied. As shown in FIG. 8A and FIG. 8B, in some embodiments, the fan blade 50 may comprise three fan blade recesses 52 at the securing end 54. The shape and positioning of the fan blade recesses 52 may be varied to suit the need and/or desires of a practitioner.

In addition, the size of a device and/or system may be scaled up or down to suit the needs and/or desires of a practitioner. Each disclosed method and method step may be performed in association with any other disclosed method or method step and in any order according to some embodiments. Where the verb "may" appears, it is intended to convey an optional and/or permissive condition, but its use is not intended to suggest any lack of operability unless otherwise indicated. Persons skilled in the art may make various changes in methods of preparing and using a device and/or system of the disclosure.

Also, where ranges have been provided, the disclosed endpoints may be treated as exact and/or approximations as desired or demanded by the particular embodiment. Where the endpoints are approximate, the degree of flexibility may vary in proportion to the order of magnitude of the range. For example, on one hand, a range endpoint of about 50 in the context of a range of about 5 to about 50 may include 50.5, but not 52.5 or 55. On the other hand, a range endpoint of about 50 in the context of a range of about 0.5 to about 50 may include 55, but not 60 or 75. In addition, it may be desirable, in some embodiments, to mix and match range endpoints. Also, in some embodiments, each figure disclosed (e.g., in one or more of the examples and/or drawings) may form the basis of a range (e.g., depicted value +/− about 10%, depicted value +/− about 50%, depicted value +/− about 100%) and/or a range endpoint. With respect to the former, a value of 50 depicted in an example and/or drawing may form the basis of a range of, for example, about 45 to about 55, about 25 to about 100 and/or about 0 to about 100.

All or a portion of a device and/or system for ceiling fans may be configured and arranged to be disposable, serviceable, interchangeable and/or replaceable. These equivalents and alternatives, along with obvious changes and modifications, are intended to be included within the scope of the present disclosure. Accordingly, the foregoing disclosure is intended to be illustrative, but not limiting, of the scope of the disclosure as illustrated by the appended claims.

The title, abstract, background, and headings are provided in compliance with regulations and/or for the convenience of the reader. They include no admissions as to the scope and content of prior art and no limitations applicable to all disclosed embodiments.

The invention claimed is:

1. A ceiling fan comprising:

a body comprising a top cover, a bottom cover, and an internal cavity defined between the top cover and the bottom cover; and a fan blade, wherein the top cover includes a plurality of circumferentially distributed blade interface sections and a plurality of circumferentially distributed curvilinear sections, the bottom cover includes a plurality of circumferentially distributed blade interface sections and a plurality of circumferentially distributed curvilinear sections, the plurality of curvilinear sections of the top cover contour against corresponding curvilinear sections of the bottom cover when the top cover is assembled over the bottom cover, a plurality of lateral recesses are respectively defined between the plurality of blade interface sections of the top cover and the plurality of blade interface sections of the bottom cover, and the fan blade extends outward through one of the lateral recesses and is fixed in the lateral recess when an end of the fan blade is secured within the internal cavity of the body.

2. The ceiling fan of claim 1, wherein the bottom cover of the body comprises a center recess.

3. The ceiling fan of claim 2, further comprising a cover panel disposed over the center recess.

4. The ceiling fan of claim 1, further comprising a motor disposed within the internal cavity of the body.

5. The ceiling fan of claim 1, further comprising a ceiling attachment secured to the top cover of the body.

6. The ceiling fan of claim 1, wherein the body comprises a substantially discoidal geometry.

7. The ceiling fan of claim 1, wherein the body comprises a substantially oblate spheroid geometry.

8. The ceiling fan of claim 1, wherein the plurality of curvilinear sections of the top cover and the plurality of curvilinear sections of the bottom cover comprise corresponding curvatures.

9. The ceiling fan of claim 1, wherein a plane of the fan blade is aligned oblique to a rotational plane of the ceiling fan.

10. The ceiling fan of claim 1, wherein the fan blade further comprises a fan blade recess extending through the fan blade.

11. The ceiling fan of claim 10, wherein the bottom cover of the body further comprises a peg configured to be secured within the fan blade recess.

12. The ceiling fan of claim 10, wherein the top cover of the body further comprises a pin configured to be secured within the fan blade recess.

13. The ceiling fan of claim 10, wherein the fan blade recess comprises a first cylindrical region and a second cylindrical region.

14. The ceiling fan of claim 13, wherein said first cylindrical region receives a peg of the bottom cover and said second cylindrical region receives a pin of the top cover.

15. The ceiling fan of claim 10, wherein a peg of the bottom cover is received along a first cylindrical region of the fan blade recess, then the peg slides into a second cylindrical region of the fan blade recess.

16. The ceiling fan of claim 1, wherein the top cover of the body further comprises a fastener opening configured to receive a fastener therein.

17. The ceiling fan of claim 1, wherein the plurality of blade interface sections of the top cover and the plurality of curvilinear sections of the top cover are circumferentially distributed in an alternating manner.

18. A method of assembling a ceiling fan, the method comprising:

providing a bottom cover of a body, the bottom cover comprising a peg;

providing a fan blade comprising a fan blade recess;

securing the peg of the bottom cover within the fan blade recess;

providing a top cover of the body, the top cover comprising a pin; and securing the pin of the top cover within the fan blade recess;

wherein the top cover and the bottom cover form an internal cavity therebetween, wherein the top cover further comprises a plurality of circumferentially distributed blade interface sections and a plurality of circumferentially distributed curvilinear sections, wherein the bottom cover further comprises a plurality of circumferentially distributed blade interface sections and a plurality of circumferentially distributed curvilinear sections, wherein the body comprises a plurality of lateral recesses, said plurality of lateral recesses respectively defined between the plurality of blade interface sections of the top cover and the plurality of blade interface sections of the bottom cover, and wherein the fan blade extends outward through one of the plurality of lateral recesses and the fan blade is fixed in the lateral recess when an end of the fan blade is secured within the internal cavity of the body.

19. The method of claim 18, wherein the bottom cover of the body comprises a center recess.

20. The method of claim 19, further comprising disposing a cover panel over the center recess.

21. The method of claim 18, further comprising disposing a motor within the internal cavity of the body.

22. The method of claim 18, wherein the body comprises a substantially discoidal geometry.

23. The method of claim 18, wherein the body comprises a substantially oblate spheroid geometry.

24. The method of claim 18, wherein the plurality of curvilinear sections of the top cover and the plurality of curvilinear sections of the bottom cover comprise corresponding curvatures.

25. The method of claim 18, wherein a plane of the fan blade is aligned oblique to a rotational plane of the ceiling fan.

26. The method of claim 18, further comprising securing a ceiling attachment to the top cover of the body.

27. The method of claim 18, further comprising securing the ceiling fan to a ceiling.

28. The method of claim 18, further comprising securing a fastener through a fastener opening of the top cover of the body.

29. The method of claim 18, wherein the fan blade recess comprises a first cylindrical region and a second cylindrical region, the peg of the bottom cover is received within the first cylindrical region and the pin of the top cover is received within the second cylindrical region.

30. The method of claim 18, wherein the plurality of blade interface sections of the top cover and the plurality of curvilinear sections of the top cover are circumferentially distributed in an alternating manner.

* * * * *